US010183798B2

(12) United States Patent
Berthault

(10) Patent No.: US 10,183,798 B2
(45) Date of Patent: Jan. 22, 2019

(54) DEVICE FOR PACKAGING AND COOKING POPCORN AND AUTOMATED METHOD FOR CLOSING SUCH A DEVICE

(71) Applicant: Francois Berthault, Saint Genis de Saintonge (FR)

(72) Inventor: Francois Berthault, Saint Genis de Saintonge (FR)

( * ) Notice: Subject to any disclaimer, the term of this patent is extended or adjusted under 35 U.S.C. 154(b) by 679 days.

(21) Appl. No.: 14/438,770

(22) PCT Filed: Oct. 26, 2012

(86) PCT No.: PCT/FR2012/052467
§ 371 (c)(1),
(2) Date: Apr. 27, 2015

(87) PCT Pub. No.: WO2014/064342
PCT Pub. Date: May 1, 2014

(65) Prior Publication Data
US 2015/0291343 A1 Oct. 15, 2015

(51) Int. Cl.
*B65D 81/34* (2006.01)
*B65D 5/10* (2006.01)
(Continued)

(52) U.S. Cl.
CPC ..... *B65D 81/3469* (2013.01); *B65B 7/18* (2013.01); *B65B 7/24* (2013.01); *B65D 5/106* (2013.01); *B65D 81/3453* (2013.01)

(58) Field of Classification Search
CPC B65D 81/3469; B65D 81/3453; B65D 5/106; B65B 7/18; B65B 7/24
See application file for complete search history.

(56) References Cited

U.S. PATENT DOCUMENTS 2,335,913 A 12/1943 Buttery
2,791,367 A * 5/1957 Mefford ..... B65D 5/0005 206/216
(Continued)

FOREIGN PATENT DOCUMENTS

DE 74 27 243 U 11/1974
DE 2004032633 A2 4/2004
(Continued)

OTHER PUBLICATIONS

International Search Report, dated May 28, 2013, from corresponding PCT application.

*Primary Examiner* — Anthony Stashick
*Assistant Examiner* — James Way
(74) *Attorney, Agent, or Firm* — Greer, Burns & Crain, Ltd.

(57) ABSTRACT

A packaging and cooking device includes a bottom, top and four side walls, each including a first fold line parallel to and slightly distant from the bottom, a second fold line parallel to the first line, two opposing side walls including two diagonal fold lines in the portion of the side walls located above the first line, the top including two flaps, each having a free edge and connected to two opposing side walls and a hooking system enabling flaps to be held in closed position. The hooking system includes a tab connected to the free edge of a first flap and a cut-out, provided in a second flap for inserting the tab in an insertion direction, the cut-out extending in a direction approximately perpendicular to the insertion direction and including a projecting shape offset relative to the ends thereof and oriented in the direction opposite to the insertion direction.

20 Claims, 5 Drawing Sheets

Figure 1:
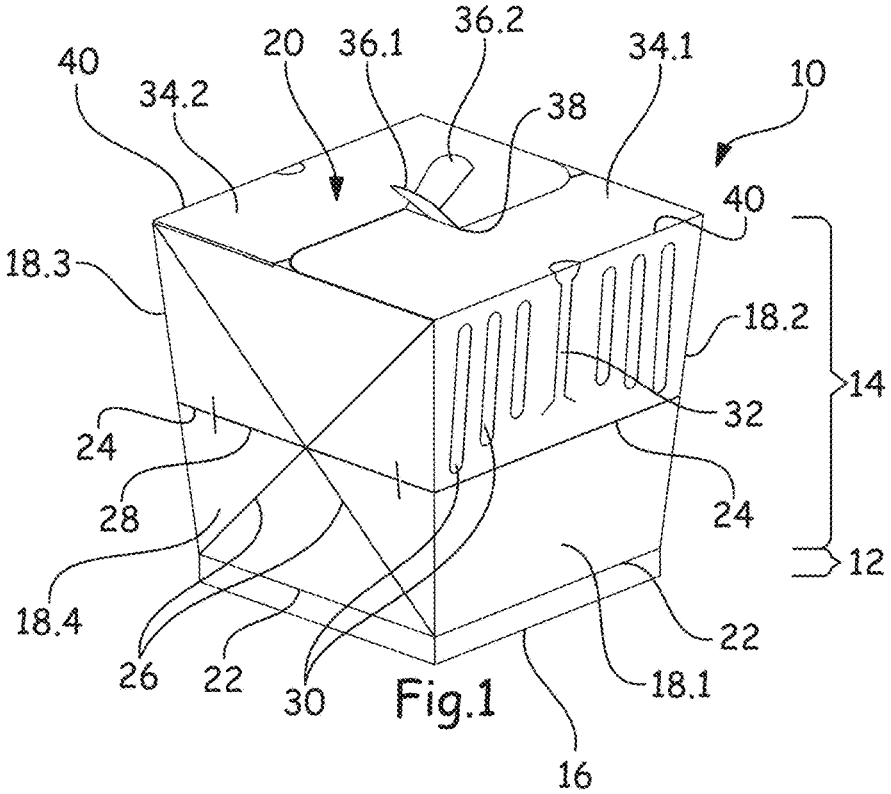

(51) Int. Cl.
*B65B 7/18* (2006.01)
*B65B 7/24* (2006.01)

(56) References Cited

U.S. PATENT DOCUMENTS

| | | | | | |
|---|---|---|---|---|---|
| 3,081,017 | A * | 3/1963 | Gerbino | B65D 5/106 | 229/155 |
| 3,201,026 | A * | 8/1965 | Travis | B65D 5/106 | 229/132 |
| 3,576,290 | A | 4/1971 | Marchisen | | |
| 3,790,064 | A * | 2/1974 | Kramer | B65D 5/106 | 229/117 |
| 4,377,917 | A * | 3/1983 | Guidry | B42D 15/042 | 229/117.01 |
| 5,358,175 | A * | 10/1994 | Cai | B65D 3/08 | 229/104 |
| 7,456,376 | B2 * | 11/2008 | Berthault | B65D 5/0005 | 219/727 |
| 2009/0277336 | A1 | 11/2009 | Berthault | | |
| 2011/0248080 | A1 | 10/2011 | Timbrook et al. | | |
| 2012/0104083 | A1 | 5/2012 | Timbrook et al. | | |

FOREIGN PATENT DOCUMENTS

| | | |
|---|---|---|
| FR | 2 918 969 A1 | 1/2009 |
| JP | 2-135480 | 2/1990 |

* cited by examiner

DEVICE FOR PACKAGING AND COOKING POPCORN AND AUTOMATED METHOD FOR CLOSING SUCH A DEVICE

This invention relates to a device for packaging and popping popcorn that comprises an improved closing system. The invention also proposes an automated method for closing such a device that is made possible by, among other things, an improved closing system.

For popcorn, there are devices for packaging kernels of corn that make it possible to pop said kernels in a microwave oven so as to transform them into popcorn. An example of such devices is described in the patent application PCT/FR03/50076 in the name of the applicant.

According to this document, a device for packaging and popping popcorn comprises a box 10 of foldable cardboard into which a tray holding the kernels of corn to be popped is inserted.

The tray is generally produced by thermoforming and comprises a series of multiple folds, one of which is made of a material that facilitates the absorption of the energy of the electromagnetic waves, also called a "susceptor." The tray is closed by a lid that is glued at the periphery with a hot-melt glue. The tray and the lid ensure airtight packaging of the kernels of corn and of additives such as sugar or vegetable oil, for example.

The cardboard box 10 has, in horizontal planes, square sections which gradually increase in size toward the top.

The box 10 has in the lower part a first, non-folding volume 12 that is surmounted by a second, folding and retractable volume 14 which makes it possible to greatly reduce the volume of the device during the phases of shipping and storage or at points of sale.

The cardboard box 10 has a bottom 16, four side walls 18.1 to 18.4 and a top 20. Each side wall 18.1 to 18.4 has a first folding line 22, parallel to and separated slightly (on the order of 1 cm) from the bottom 16, and a second folding line 24, parallel to the first folding line 22 and situated equidistant from the first folding line 22 and from the top 20.

Two opposite side walls 18.2 and 18.4 have, in addition to the first and second folding lines, two diagonal folding lines 26 in the parts of the side walls located above the first folding line 22. These same walls 18.2 and 18.4 have cuts 28 in the area of the second folding lines 24 to make it possible for the box to be folded and unfolded.

According to the embodiment described in the document PCT/FR03/50076, the box can occupy two extreme positions, a storage position in which the side wall parts located above the first folding lines are flattened against one another above the first volume 12, and an unfolded position in which the side walls are folded and delimit a large volume, making it possible to pop the kernels of corn.

In addition, the box has openings 30 to remove heat and handles 32 to unfold it.

According to this document, the top 20 of the box has two fold-overs connected to the side walls 18.2 and 18.4 and two flaps 34.1 and 34.2 connected to the other side walls 18.1 and 18.3 along hinge lines 40. When they are folded down, the flaps 34.1 and 34.2 overlap slightly so as to close the box. The flaps 34.1 and 34.2 comprise a hooking system to keep them in the closed position. Thus, each flap has a tab 36.1 or 36.2 that is hinged relative to the rest of the flap along a median folding line 38 that is perpendicular to the hinge line. The tabs 36.1 and 36.2 face in the opposite direction and form hooks that work with one another so as to keep the flaps in the closed position.

The box is made from a cardboard blank.

After the blank is cut and creased, the box is shaped. The flaps and fold-overs on the top of the box are situated in the extensions of the side walls. Next, a tray is placed at the bottom of the box. This manual operation could be automated. The flared shape of the box facilitates the insertion of the tray.

After the tray is put into position, the box is closed manually, and the side walls are also folded manually.

Even if the folding of the fold-overs and of the flaps can be easily automated, the closing of the flaps by means of the previously described hooking system proves to be very complex.

After the box is closed, the side walls must be folded. As in the case of closing, this step is difficult to automate.

According to another constraint, during the popping of the kernels of corn, the box must offer a large volume to make it possible for the grains to burst without being compressed. Otherwise, the popcorn tends to burn.

Now, the volume necessary for optimal popping of all the kernels of corn varies from one box to the next. Thus, it can happen that the volume of the box is not sufficient. Now, the hooking system with the two tabs allows no variation in the volume of the box. To eliminate this drawback, one solution consists in removing the tabs from the flaps. In this case, the flaps can rise slightly to provide additional volume if necessary. This solution is not satisfactory, because the user must remember to remove the tabs prior to popping.

Also, this invention aims to eliminate the drawbacks of the prior art by proposing a system for hooking the flaps that makes it possible to simplify the automation of the step for closing the flaps. According to another objective, the hooking system must make it possible for the flaps to rise slightly to offer additional volume for optimal popping of all the kernels of corn.

For this purpose, the invention has as its object a device for packaging and popping that has a bottom, a top and four side walls, which each have a first folding line that is parallel to and slightly separate from the bottom, a second folding line that is parallel to the first folding line, and two opposite side walls that have two diagonal folding lines in the parts of the side walls located above the first folding line, with the top comprising two flaps, each one with a free edge connected to two opposite side walls and a hooking system that makes it possible to keep the flaps in the closed position, characterized in that the hooking system comprises a tab connected to the free edge of a first flap and a cut made in a second flap into which the tab can be inserted in one direction and an insertion direction, with said cut extending in a direction approximately perpendicular to the direction of insertion and comprising a protruding shape that is offset relative to its ends, oriented in a direction opposite to the insertion direction.

Additionally, the invention proposes a production line that makes it possible to close and fold the device according to the invention automatically.

For this purpose, the invention has as its object a production line that ensures the closing and folding of a device according to one of the preceding claims, wherein it comprises a station for closing the flaps with a support on which a closing device is placed and an actuator which is translated in a direction perpendicular to the support so as to press on the flaps, with the travel of the actuator being determined in such a way that at the end of travel, the free edge of the tab goes under the protruding shape of the cut.

Figure 2:
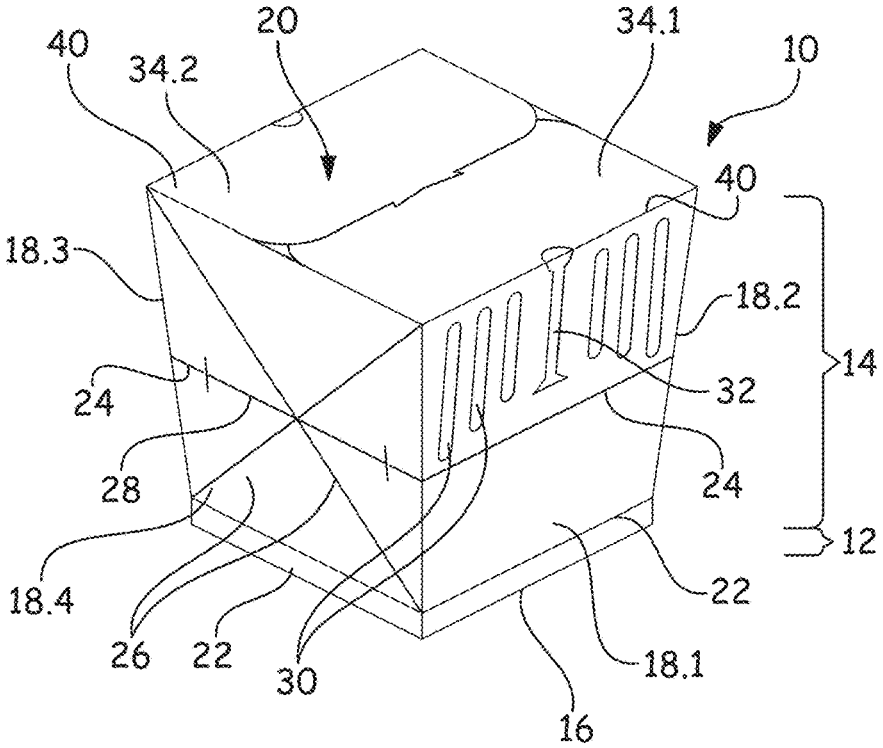
Figure 3A:
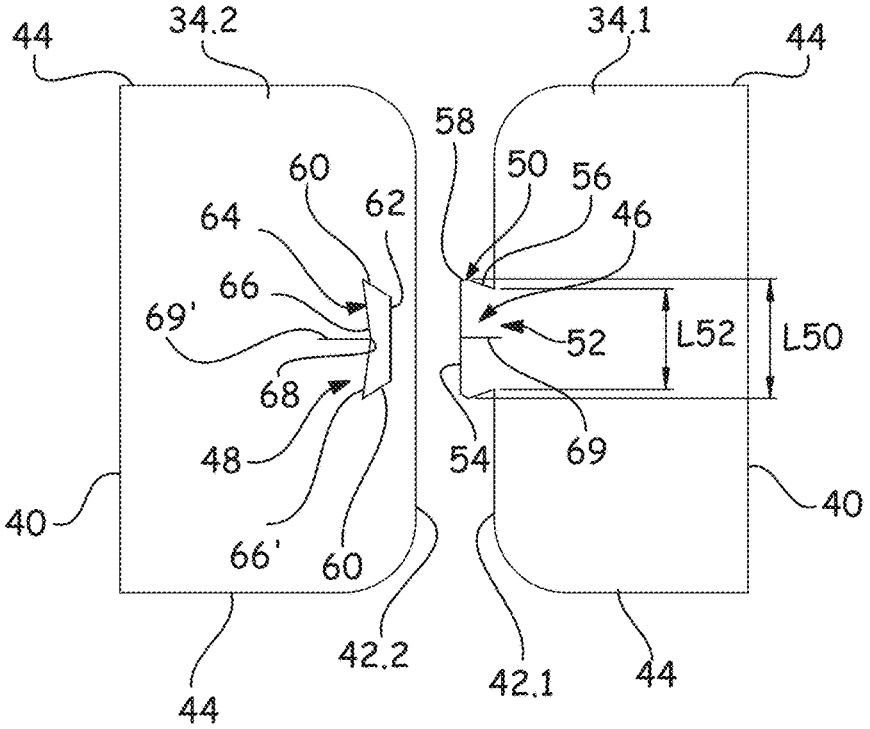
Figure 3B:
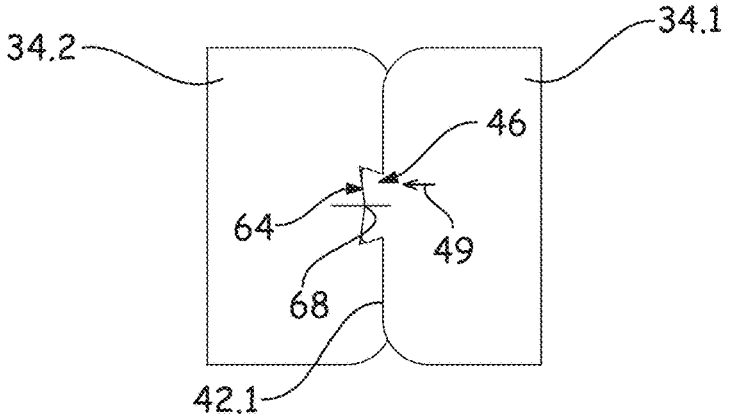
Figure 3D:
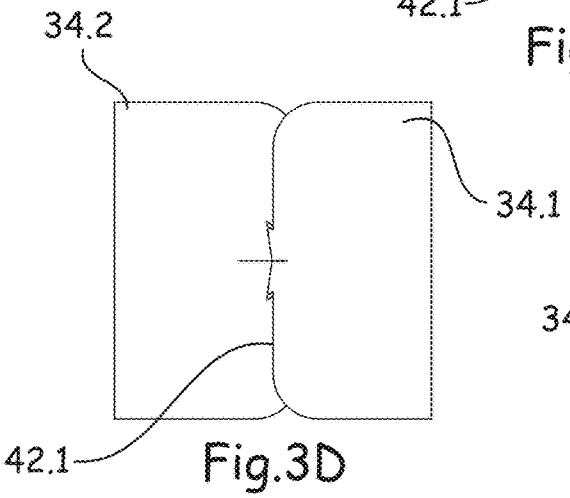
Figure 3C:
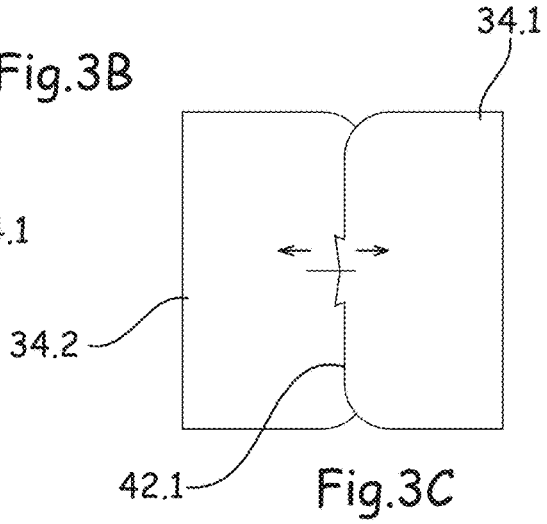
Figure 4A:
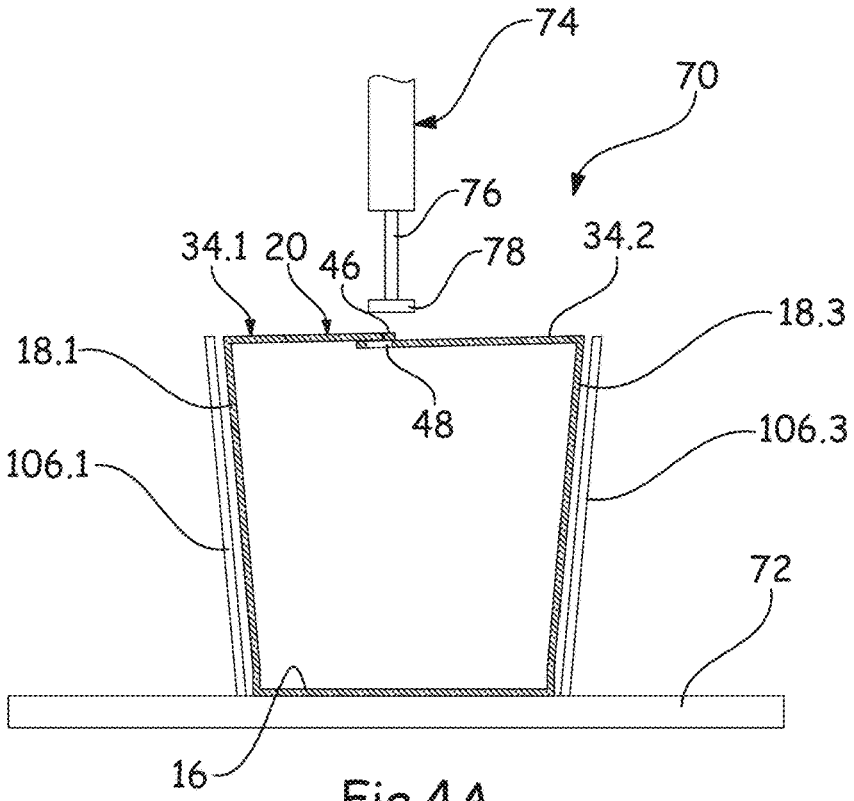
Figure 4B:
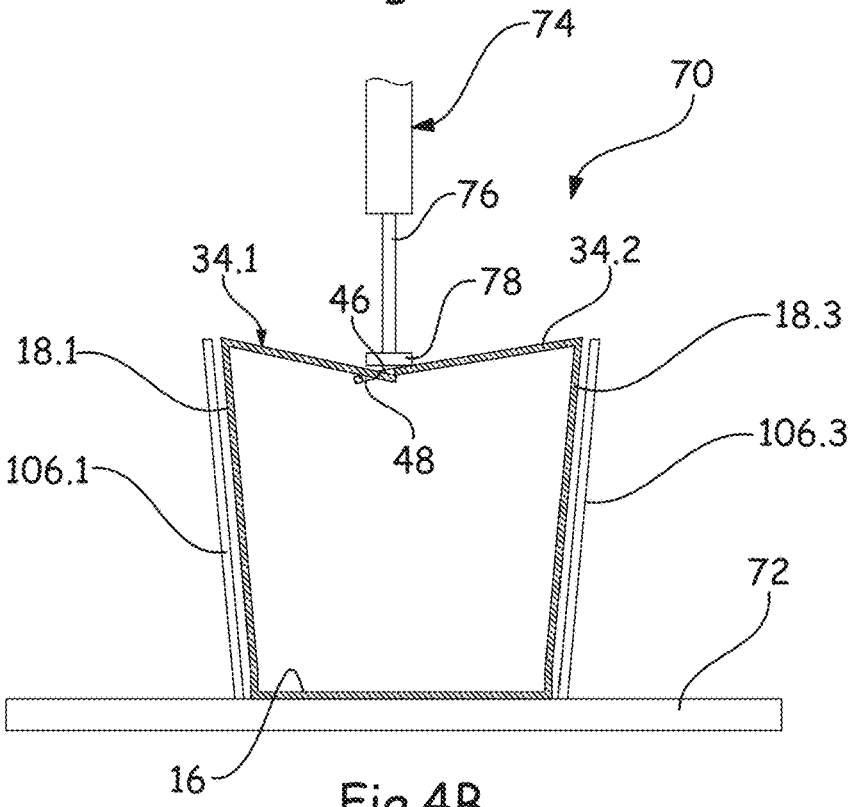
Figure 5A:
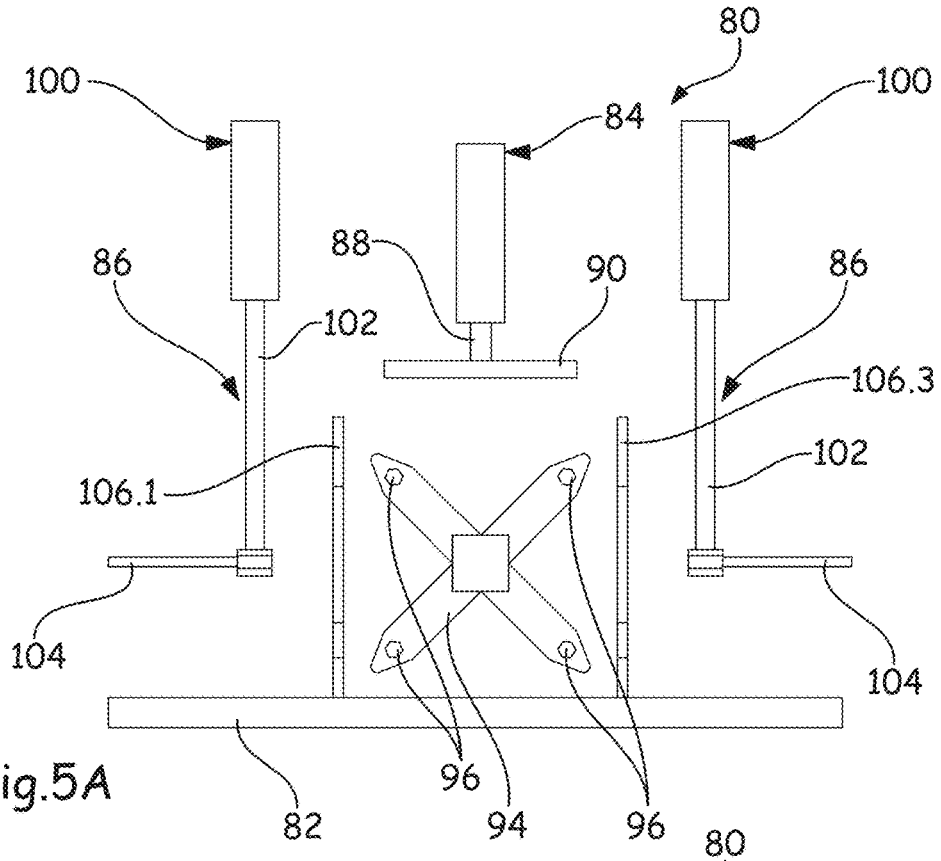
Figure 5B:
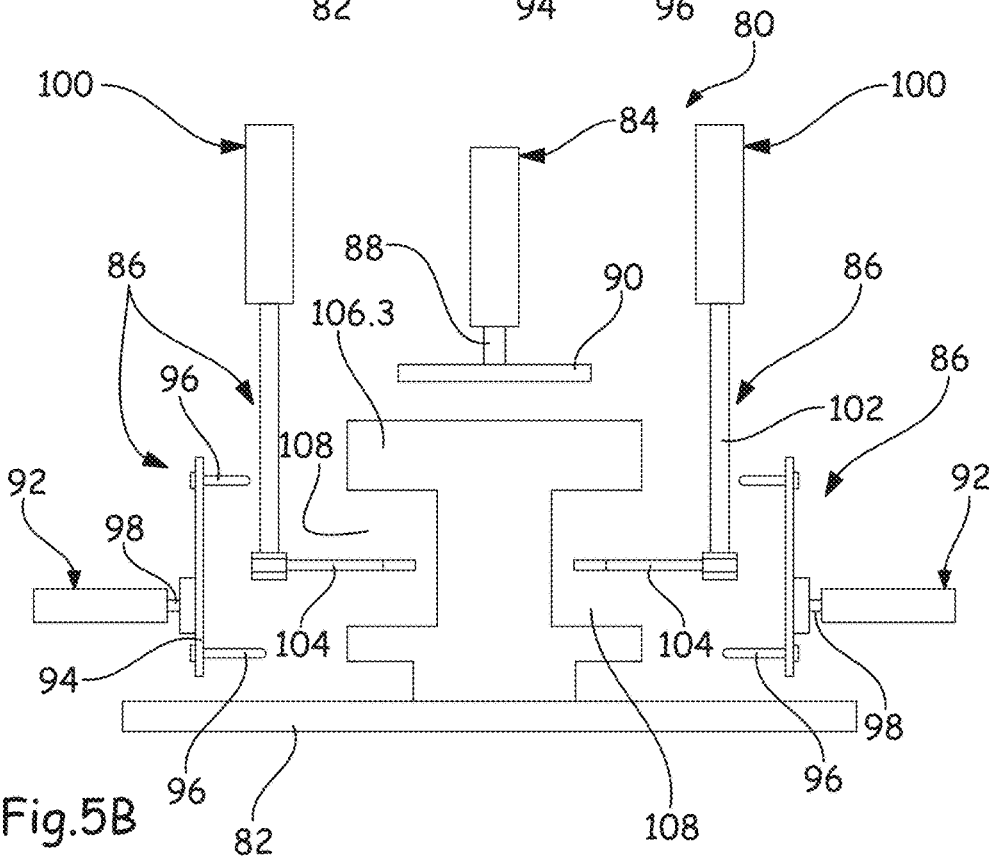
Figure 6A:
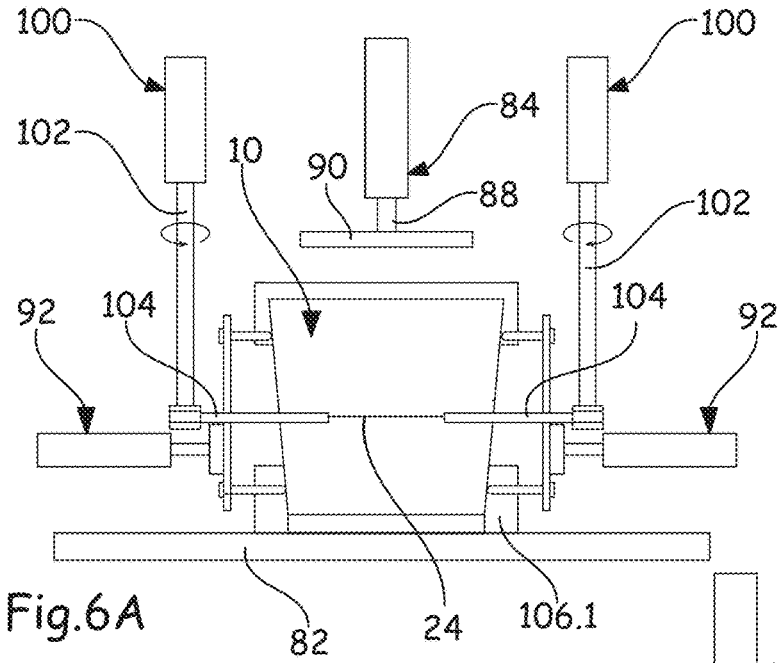
Figure 6B:
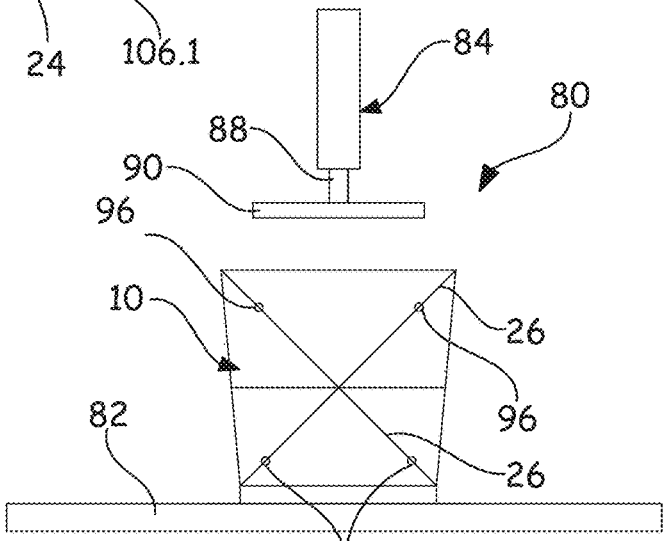
Figure 6C:
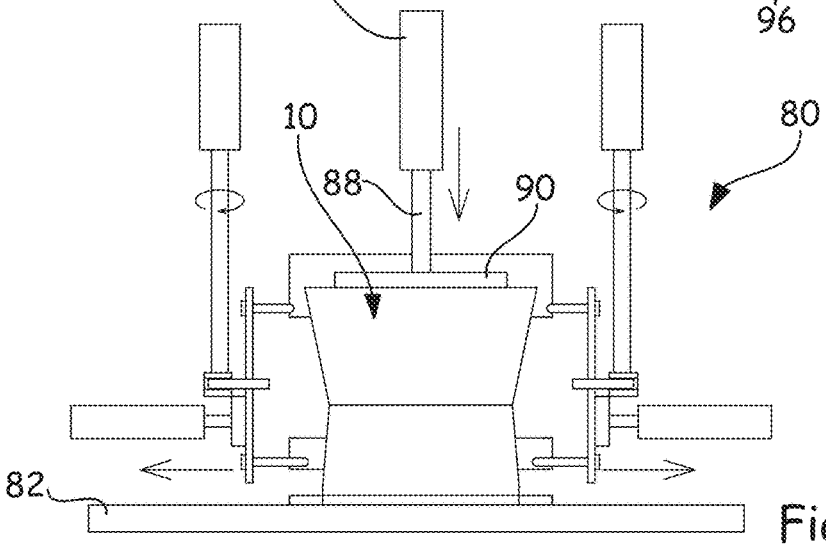

Other characteristics and advantages will become evident from the following description of the invention, a description given by way of example only, with regard to the accompanying drawings in which:

FIG. 1 is a view in perspective of a device for packaging and popping popcorn according to the prior art, FIG. 2 is a view in perspective of a device for packaging and popping popcorn according the invention, FIG. 3A is a top view of two flaps situated flat, unhooked, beside one another, FIG. 3B is a top view of the two flaps of FIG. 3A in the course of hooking, FIG. 3C is a top view of the two flaps of FIG. 3A, hooked, FIG. 3D is a top view of the two flaps of FIG. 3A, hooked, at the end of popping, FIG. 4A is a side view of a station at rest for closing the flaps, FIG. 4B is a side view of the station of FIG. 4A in operation at the time when the flaps are hooked, FIG. 5A is a view of a first side of a station that makes it possible to fold the side walls, FIG. 5B is a view of a second side of a station that makes it possible to fold the side walls, FIG. 6A is a side view illustrating the station of FIG. 5A during one step of the folding, FIG. 6B is a side view illustrating the station of FIG. 5B during another step of the folding, and FIG. 6C is a side view illustrating the station of FIG. 5A during the final step of the folding.

In FIG. 2, a device for packaging and popping according to the invention has been depicted. Except for the top, the rest of the device can be in conformity with that of the prior art, with the elements common to the prior art being referenced in the same manner. Thus, it comprises a box 10 of foldable cardboard into which a tray is inserted that contains the kernels of corn to be popped.

The box 10 has in the lower part a first, non-folding volume 12 that is surmounted by a second, folding and retractable volume 14 which makes it possible to greatly reduce the volume of the device during phases of shipping and storage or at points of sale.

The cardboard box 10 has a bottom 16, four side walls 18.1 to 18.4 and a top 20. Each side wall 18.1 to 18.4 has a first folding line 22, parallel to and separated slightly (on the order of 1 cm) from the bottom 16, and a second folding line 24, parallel to the first folding line 22 and placed equidistant from the first folding line 22 and from the top 20.

In addition to the first and second folding lines, two opposite side walls 18.2 and 18.4 have two diagonal folding lines 26 in the parts of the side walls located above the first folding line 22. These same walls 18.2 and 18.4 have cuts 28 at the level of the second folding lines 24 to make it possible for the box to be folded and unfolded.

In addition, the box has openings 30 to remove the heat and handles 32 to unfold it.

As in the case of the prior art, the top 20 has two fold-overs connected to the side walls 18.2 and 18.4 and two flaps 34.1 and 34.2 connected to the other side walls 18.1 and 18.3 along hinge lines 40. When they are folded down, the flaps 34.1 and 34.2 overlap so as to close the box.

According to a simplified variant, the top may not have fold-overs.

According to one embodiment, illustrated in FIG. 3A, each flap has a rectangular shape, with two long sides, namely the hinge line 40 and the opposite free edge 42.1 or 42.2 and two small sides 44. Advantageously, the corners of the free edge 42.1 or 42.2 with the small sides 44 are rounded.

As in the prior art, the box has a hooking system to keep the flaps in the closed position.

According to the invention, the hooking system has a tab 46 connected to the free edge 42.1 of a flap 34.1 and a slot 48 made in the other flap 34.2 into which the tab 46 can be inserted in an insertion direction, with the insertion direction being referenced 49, as illustrated in FIG. 3B.

The tab 46 has a head 50 and a joining area 52 that provides the connection between the head 50 and the flap 34.1. According to an important point of the invention, the head 50 has a width L50 that is greater than the width L52 of the joining area 52. For the rest of the description, the head 50 corresponds to the widest part of the tab.

According to one embodiment, the tab 46 is delimited by two lateral edges and a free edge 54 that is parallel to the free edge 42.1 of the flap 34.1. Each lateral edge has two straight segments, a first straight segment 56 that extends from the free edge 42.1 up to the second straight segment 58, which extends up to the free edge 54 of the tab 46.

The two first segments 56 of the tab are not parallel. Thus the distance (parallel to the free edge 42.1) separating the two first segments 56 gradually increases as it moves away from the free edge 42.1 of the flap.

In addition, the two second segments 58 of the tab are not parallel. Thus the distance (parallel to the free edge 42.1) separating the two second segments 58 gradually decreases as it moves away from the free edge 42.1 of the flap.

Thus, the tab 46 has a width that gradually increases from the free edge 42.1 of the flap up to the area of the head 50, and then it narrows. In the area of the free edge 54, the head 50 has bevel angles formed by the straight second segments 58 that facilitate the insertion of the tab 46 into the slot 48.

The slot 48 is offset toward the hinge line 40 relative to the free edge 42.2 of the flap 34.2.

The slot 48 is delimited by four sides, two small sides 60, a first large side 62 (near the free edge 42.2 of the flap 34.2) and a second large side 64.

According to one embodiment, the large side 62 is straight and parallel to the free edge 42.2 of the flap 34.2. According to one embodiment, the width of the large side 62 is equal to or slightly less than the width of the joining area L52.

Advantageously, the distance (parallel to the free edge 42.2) between the small sides 60 increases as it moves away from the free edge 42.2. This configuration makes it possible to facilitate the insertion of the tab 46 into the slot 48.

The maximum distance between the small sides 60 (in the area of the large side 64) is equal to or very slightly greater than the width L50 of the head 50. This arrangement makes it possible for the tab to penetrate into the slot.

According to an embodiment, the angle formed by the small sides 60 is greater than the angle formed by the first segments 56 of the tab. This arrangement facilitates the insertion of the tab into the slot.

According to an important point of the invention, the large side 64 of the slot (the farthest away from the free edge 42.2) is not straight. It has a protruding shape 68 that is offset relative to its ends, oriented toward the other large side 62 of the slot 48, in the direction opposite to the insertion direction. The large side 62 is approximately perpendicular to the direction of insertion.

As a variant, the slot 48 can be limited to a slit or a cut whose profile conforms to the large side 64.

In all cases, the flap 34.2 comprises a cut 64 which corresponds optionally to one side of a slit or a slot which extends in an approximately perpendicular direction to the direction of insertion and which has a protruding shape 68 that is offset relative to its ends, oriented in the direction opposite to the insertion direction.

Advantageously, the cut has a profile that is symmetrical relative to the right bisector of the cut. In the case of a slot, the distance separating the two large sides 62 and 64 is the smallest in the area of the right bisector.

The right bisector of the large side 64 corresponds to the straight line perpendicular to the free edge 42.2 of the flap 34.2 which is equidistant from the ends of the large side 64.

According to one embodiment, the large side 64 has two straight segments 66, 66', having the same length, which form a peak 68 in the direction of the large side 62 or oriented in the direction opposite to the direction of insertion of the tab.

As a variant, the large side 64 describes an arc that is symmetrical relative to the right bisector of the large side 64.

The positioning of the slot 48 is such that when the flaps 34.1 and 34.2 are in the closed position:

- the free edge 42.1 of the flap 34.1 is situated approximately directly above the large side 62 (the closest to the free edge 42.2 of the flap 34.2) or slightly offset toward the other large side 64,
- the head 50 of the tab is situated between the large side 64 and the hinge line 40 of the flap 34.2.

When the flaps are in the closed position (approximately horizontal), the distance that separates the free edge 54 of the tab 46 and the end of the protruding shape 68 is such that, if the free edge 54 is situated above the flap 34.2, it can go under the protruding shape 68 when the flaps are deformed toward the interior of the box.

Thanks to the shapes of the tab and the slot, the closing of the flaps is greatly simplified. Actually, it is only necessary to situate the free edge 42.1 of the flap 34.1 carrying the tab above the free edge 42.2 of the flap 34.2 and to exert a downward force, at the center of the box. When the flaps are curved toward the interior of the box, beyond a certain threshold, the free edge 54 of the tab 46 goes under the protruding shape 68, as illustrated in the FIGS. 3B and 4B. From this moment on, it is no longer necessary to exert the force on the flaps, which return to the horizontal position. During this movement, the tab is inserted into the slot, coming into a hooked position as illustrated in FIG. 3C.

According to another advantage, during popping, the shapes of the tab and of the slot make it possible for the flaps to be deformed upward so as to increase the volume of the box, as illustrated in FIG. 3D. The protruding shape 68 holds the tab 46 and makes it possible to keep the flaps from opening all the way.

To improve the insertion of the tab in the slot, the tab 46 can have a folding line 69 in the area of its right bisector. In addition, the flap 34.2 can have a folding line 69' or a cut which extends from the large side 64 in the direction of the hinge line 40, along the right bisector of the large side 64.

The invention proposes a production line that makes it possible to assemble a box, insert a tray into the box, close the flaps and fold the box.

The part of the production line that ensures the assembly and insertion of the tray will not be described in any further detail because it is known to one skilled in the art.

As shown in FIGS. 4A and 4B, a station 70 for closing the flaps comprises a movable or stationary support 72 on which the box to be closed rests.

Directly above the box, the closing station 70 comprises an actuator 74 which is translated in a direction perpendicular to the support 72. According to one embodiment, the actuator 74 comprises a cylinder with a movable rod 76 whose end 78 is capable of pressing on the top of the box.

In the area of the closing station or upstream, actuators are provided for folding the flaps 34.1 and 34.2 and the optional fold-overs. The fold-overs are situated under the flaps, and the flap 34.1 that has the tab 46 is situated above the other flap 34.2.

The box is placed on the support 72, below the actuator 74, with the tab 46 and the slot 48 being situated directly above the actuator 74. In the rest position, as shown in FIG. 4A, the actuator 74 does not interfere with the box.

In operation, the rod 76 of the actuator is translated downward, and its end 78 presses on the flaps 34.1 and 34.2. The latter are slightly deformed toward the interior. The travel of the rod 76 is determined such that at the end of travel, the free edge 54 of the tab 46 goes under the protruding shape 68 of slot 48, as shown in FIG. 4B. When the free edge 54 has passed under the protruding shape, the rod 76 of the cylinder is translated upward to a rest position. The flaps then return to their initial positions (in the horizontal). During this movement, the tab 46 penetrates into the slot 48.

After the flaps 34.1 and 34.2 are closed, the box is folded in the area of a folding station 80 shown in FIGS. 5A, 5B, 6A to 6C.

This folding station 80 comprises a movable or stationary support 82 on which are placed a box with closed flaps, an actuator 84 which is translated in a direction perpendicular to the support 82 and means 86 to initiate the folding of the side walls. According to one embodiment, the actuator 84 comprises a cylinder with a movable rod 88 whose end 90 is capable of pressing against the top of the box so as to fold the side walls.

The box to be folded is placed under the actuator 84 such that the force exerted by the actuator 84 is approximately centered on the top 20 of the box.

In operation, the rod 88 of the actuator is translated downward, and its end 90 presses on the top 20. The travel of the actuator is determined such that the end 90 does not descend below the first folding lines 22. The end 90 generally comprises a plate to distribute the pressure forces over a large surface area.

The means 86 to initiate the folding of the side walls act simultaneously on the four side walls 18.1 to 18.4.

For the side walls 18.2 and 18.4 with diagonal folding lines, the means 86 comprise two actuators 92 situated facing each other, each with a plate 94 bearing four pins 96. The ends of the pins 96 act simultaneously against the two side walls 18.2 and 18.4. The pins 96 are situated so as to press against the side walls 18.2 and 18.4 in the area of the diagonal folding lines 26, with each pin 96 being situated approximately equidistant from the point of intersection of the diagonal folding lines 26 and from one of the ends of the diagonal folding lines 26.

According to one embodiment, each actuator 92 is a cylinder with a rod 98 capable of being translated in a direction approximately perpendicular to the side walls, with a plate 94 being attached to the end of each rod 98.

In a first state known as a state of rest, the plates 94 are separated from the box, and the pins 96 do not interfere with the side walls 18.2 and 18.4. As shown in FIG. 6B, when the actuators are in a second, actuated state, the two plates 94 approach one another, and the pins 96 act simultaneously on the two side walls 18.2 and 18.4 in the area of the diagonal folding lines. This action causes a slight deformation of the side walls toward the interior of the box.

The means 86 comprise for the side walls 18.1 and 18.3 at least two actuators 100, at least one for each wall. These actuators are able to occupy two states, a first state in which they do not interfere with the side walls 18.1 and 18.3, and a second state in which they act simultaneously on the two side walls 18.1 and 18.3 in the area of the second folding lines 24.

According to an embodiment shown in FIGS. 5A, 5B and 6A, the means 86 comprise four actuators 100 able to cause a shaft 102 to pivot approximately parallel to the vertical edges of the side walls, with each shaft bearing a finger 104 situated at the height of the second folding lines 24. In the first state, the fingers 104 are separated from the faces. In the second state, after pivoting of the shafts 102, the fingers exert a force on the side walls 18.1 and 18.3 at the height of the second folding lines 24 so as to slightly deform said side walls 18.1 and 18.3 toward the interior.

Advantageously, as illustrated in the FIGS. 5A and 6A, the support 82 comprises two plates 106.1 and 106.3 between which a box can be placed. The distance between the two plates 106.1 and 106.3 is determined such that the side walls 18.1 and 18.3 are in contact with, respectively, the plates 106.1 and 106.3. These plates 106.1 and 106.3 make it possible to limit the deformations of the side walls 18.1 and 18.3 toward the interior.

Preferably, the plates 106.1 and 106.3 have dimensions that are approximately equal to those of the side wall 18.1 and 18.3. In this case, they comprise cuts 108 that make it possible for the actuators 100 to act on the walls 18.1 and 18.3.

The operation of the folding station is as follows:

In a first step, a box is placed on the support 82 between the plates 106.1 and 106.3. Next, the actuators 92 and 100 are activated simultaneously or slightly offset in time so as to slightly deform the side walls 18.1 to 18.4 toward the interior of the box.

Next, the actuator 84 is activated. When the end 90 begins to press on the top 20 of the box, the pins 96 and the fingers 104 are retracted so as no longer to interfere with the box and not to hamper the folding movement of the box. The end 90 of the actuator 84 continues its travel until the box is completely folded.

Next, a film wrapping station makes it possible to film-wrap the boxes in the folded position.

According to a preferred embodiment, the supports 72 and 82 come in the form of a belt that travels under all the stations, with said belt comprising a host of plates 106.1 and 106.3 against which two side walls are flattened, which ensure the holding of the boxes.

The invention claimed is:

1. A device for packaging and cooking, the device comprising:

a bottom, a top and four side walls which each have a first folding line that is parallel to and slightly separate from the bottom, a second folding line that is parallel to the first folding line, two opposite side walls that have two diagonal folding lines in the side walls located above the first folding line, with the top comprising two flaps, each one with a free edge connected to two opposite side walls and a hooking system that keeps the flaps in a closed position, wherein the hooking system comprises a tab connected to the free edge of a first flap and a cut made in a second flap into which the tab can be inserted in one direction and an insertion direction, with said cut extending in a direction approximately perpendicular to the direction of insertion and comprising a side with a protruding shape that is offset relative to its ends in a direction opposite to the insertion direction, wherein the tab has a head and a joining area connecting the head and the flap, the joining area having a width that is less than a width of the head, and wherein the free edge of the flap having the protruded shape is located above the free edge of the other flap so as to close the flaps by only applying a downward force on the flaps at a center of the device.

2. The device according to claim 1, wherein the cut has a profile that is symmetrical relative to the right bisector of the cut.

3. The device according to claim 2, wherein the protruding shape comprises two straight segments that have the same length and that form a peak.

4. The device according to claim 1, wherein the tab has a free edge that is separated from the end of the protruding shape by a distance such that, if the free edge is situated above the flap comprising the cut, the free edge passes under the protruding shape when the flaps are deformed toward the interior of the device.

5. The device according to claim 1, wherein the second flap has a slot, one side of which corresponds to the cut.

6. The device according to claim 5, wherein the slot has small sides that diverge while moving away from the free edge of the flap in which the slot is made.

7. The device according to claim 1, wherein the head has bevel angles that facilitate the insertion of the tab.

8. The device according to claim 2, wherein the tab has a free edge that is separated from the end of the protruding shape by a distance such that, if the free edge is situated above the flap comprising the cut, the free edge passes under the protruding shape when the flaps are deformed toward the interior of the device.

9. The device according to claim 2, wherein the second flap has a slot, one side of which corresponds to the cut.

10. The device according to claim 2, wherein the tab has a head and a joining area ensuring the connection between the head and the flap whose width is less than that of the head.

11. The device according to claim 1, wherein the joining area has two lateral edges.

12. The device according to claim 1, wherein the protruding shape comprises a folding line extending away from the cut along the insertion direction.

13. The device according to claim 1, wherein the second flap has a slot, a first side of the slot corresponding to the cut, and wherein a width of the first side of the slot is equal to or greater than the width of the head.

14. The device according to claim 13, wherein the slot further comprises a second side, the second side opposite the first side, and the second side having a width equal to or less than the width of the joining part.

15. The device according to claim 14, wherein the slot further comprises two small sides each extending between the first side and the second side, and wherein a distance between the two small sides increases while moving along the small sides in a direction away from the free edge of the flap in which the slot is made.

16. The device according to claim 15, wherein the joining area has two lateral edges that each intersect with the free edge of the first flap forming a set of first angles, and wherein the small sides each intersect with the second side forming a set of second angles, wherein the second angles are greater than the first angles.

17. A device for packaging and cooking, the device comprising:

a bottom, a top and four side walls which each have a first folding line that is parallel to and slightly separate from the bottom, a second folding line that is parallel to the first folding line, two opposite side walls that have two diagonal folding lines in the side walls located above the first folding line, with the top comprising two flaps, each one with a free edge connected to two opposite side walls and a hooking system that keeps the flaps in a closed position, and, wherein the hooking system comprises a tab connected to the free edge of a first flap and a cut made in a second flap into which the tab can be inserted in one direction and an insertion direction, with said cut extending in a direction approximately perpendicular to the direction of insertion and comprising a side with a protruding shape that is offset relative to its ends in a direction opposite to the insertion direction, wherein the tab has a head and a joining area connecting the head and the flap, the joining area having a width that is less than a width of the head.

18. The device according to claim 17, wherein the second flap has a slot, a first side of the slot corresponding to the cut, and wherein a width of the first side of the slot is equal to or greater than the width of the head.

19. The device according to claim 18, wherein the slot further comprises a second side, the second side opposite the first side, and the second side having a width equal to or less than the width of the joining part.

20. A device for packaging and cooking, the device comprising:

a bottom, a top and four side walls which each have a first folding line that is parallel to and slightly separate from the bottom, a second folding line that is parallel to the first folding line, two opposite side walls that have two diagonal folding lines in the side walls located above the first folding line, with the top comprising two flaps, each one with a free edge connected to two opposite side walls and a hooking system that keeps the flaps in a closed position, wherein the hooking system comprises a tab connected to the free edge of a first flap and a cut made in a second flap into which the tab can be inserted in one direction and an insertion direction, with said cut extending in a direction approximately perpendicular to the direction of insertion and comprising a side with a protruding shape that is offset relative to its ends in a direction opposite to the insertion direction, and wherein the protruding shape comprises a folding line extending away from the cut along the insertion direction.

* * * * *